US005775465A

United States Patent [19]

Vossler

[11] Patent Number: 5,775,465

[45] Date of Patent: Jul. 7, 1998

[54] LADDER SUPPORT

[76] Inventor: Darby J. Vossler, P.O. Box 286, Elkhorn, Nebr. 68022

[21] Appl. No.: 843,997

[22] Filed: Apr. 18, 1997

[51] Int. Cl.[6] ..... E06C 7/48

[52] U.S. Cl. ..... 182/214; 182/107

[58] Field of Search ..... 182/214, 107

[56] References Cited

U.S. PATENT DOCUMENTS

| | | | |
|---|---|---|---|
| 543,513 | 7/1895 | Somers | 182/214 |
| 1,467,597 | 9/1923 | Wendel | 182/214 |
| 1,478,823 | 12/1923 | Gauss | 182/214 |
| 2,307,343 | 1/1943 | Reed | 182/214 |
| 5,664,643 | 9/1997 | Taylor | 182/214 |

*Primary Examiner*—Alvin C. Chin-Shue
*Attorney, Agent, or Firm*—Zarley, McKee, Thomte Voorhees & Sease; Mark D. Frederiksen

[57] ABSTRACT

A ladder support apparatus includes a generally U-shaped roof attachment portion having a pair of spaced apart legs connected at rearward ends to a base. The legs have apertures formed therethrough to receive nails which will releasably fasten the roof attachment portion to the roof or other portion of a building. A ladder retention portion includes a strap formed into a loop, with the upper end of a ladder slidably journaled through the loop. The ladder retention portion is connected to the roof attachment portion of the ladder support apparatus, to retain the upper end of a ladder in position relative to the roof attachment portion.

7 Claims, 4 Drawing Sheets

LADDER SUPPORT

TECHNICAL FIELD

The present invention relates generally to support apparatus for extension ladders, and more particularly to an improved ladder support retaining the upper end of an extension ladder in position, while permitting raising and lowering of the ladder.

BACKGROUND OF THE INVENTION

It is common to utilize a pair of extension ladders with a plank extending between support brackets on the ladders to act as a scaffold, when siding a building. However, such scaffolds suffer several problems.

The main problem with a ladder type scaffold is in the fact that the upper end of the ladder is not secured. Thus, wind will cause the ladder to shift and move, and potentially blow down. This movement can damage the building, as well as the scaffold and any equipment or workers using the scaffold.

Another problem with ladder type scaffolds is apparent when using the ladder on buildings with no overhanging roof. In such a case, there is inadequate room for the scaffold planks between the ladder and the roof.

SUMMARY OF THE INVENTION

It is therefore a general object of the present invention to provide an improved ladder support for extension type ladders.

Another object is to provide a ladder support which may be attached directly to a roof of any slope.

Still another object of the present invention is provide a ladder support which will hold the upper end of the ladder in a secured position, while permitting raising and lowering of the ladder.

These and other objects of the present invention will be apparent to those skilled in the art.

The ladder support apparatus of the present invention includes a generally U-shaped roof attachment portion having a pair of spaced apart legs connected at rearward ends to a base. The legs have apertures formed therethrough to receive nails which will releasably fasten the roof attachment portion to the roof or other portion of a building. A ladder retention portion includes a strap formed into a loop, with the upper end of a ladder slidably journaled through the loop. The ladder retention portion is connected to the roof attachment portion of the ladder support apparatus, to retain the upper end of a ladder in position relative to the roof attachment portion.

DESCRIPTION OF THE PREFERRED EMBODIMENT

Figure 1:
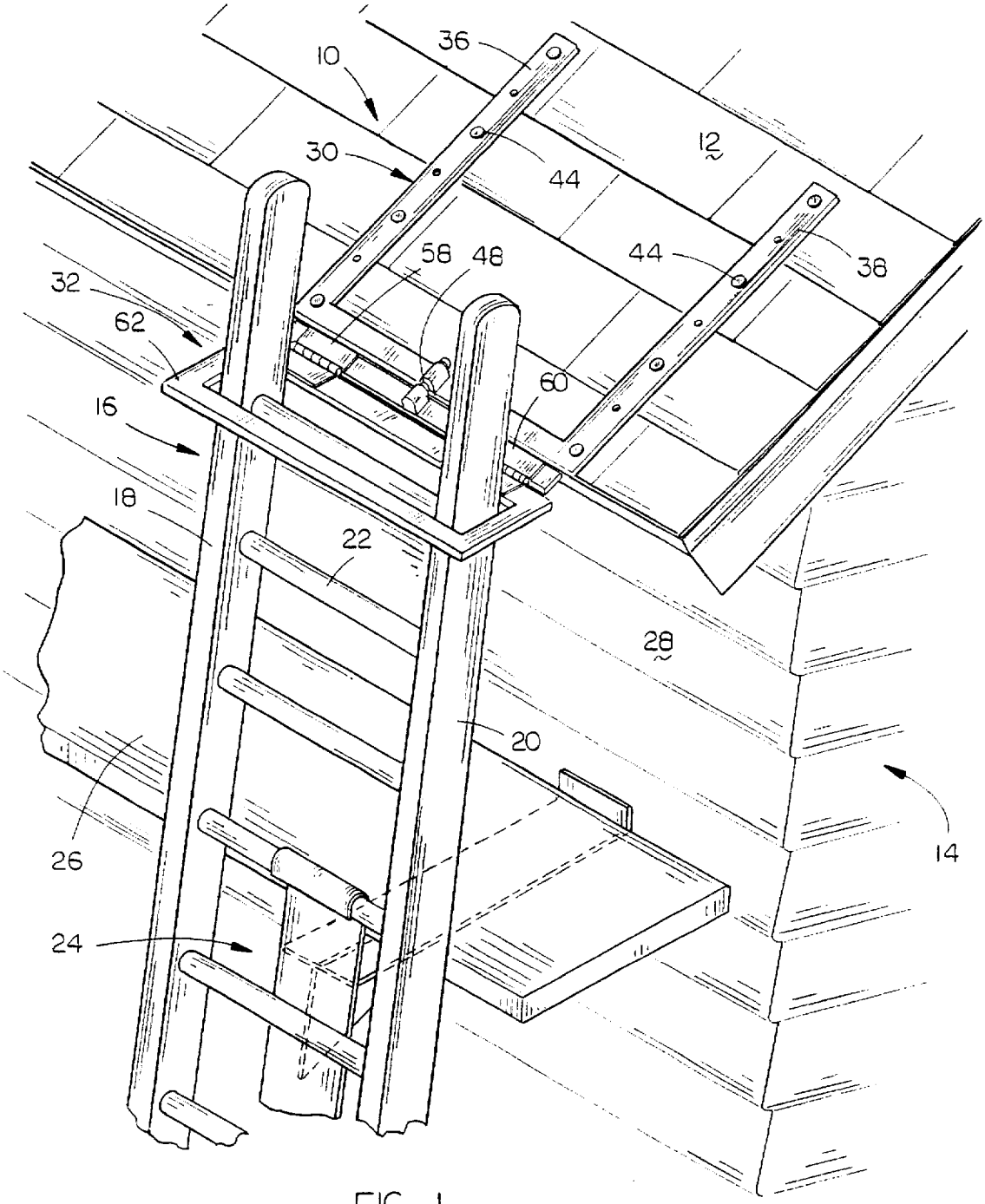
FIG. 1 is a perspective view of the ladder support of the present invention retaining an extension ladder in position on a building.

Referring now to the drawings, in which similar or corresponding parts are identified with the same reference numeral, and more particularly to FIG. 1, the ladder support of the present invention is designated generally at 10 and is shown attached to the roof 12 of a building 14 and supporting a conventional extension ladder 16.

Extension ladder 16 is of conventional design, having a pair of spaced apart parallel rails 18 and 20 interconnected by a plurality of rungs 22. A conventional scaffold bracket 24 is shown attached to rungs on ladder 16, and supporting a plank 26 between the ladder 16 and a wall 28 of building 14.

Figure 2:
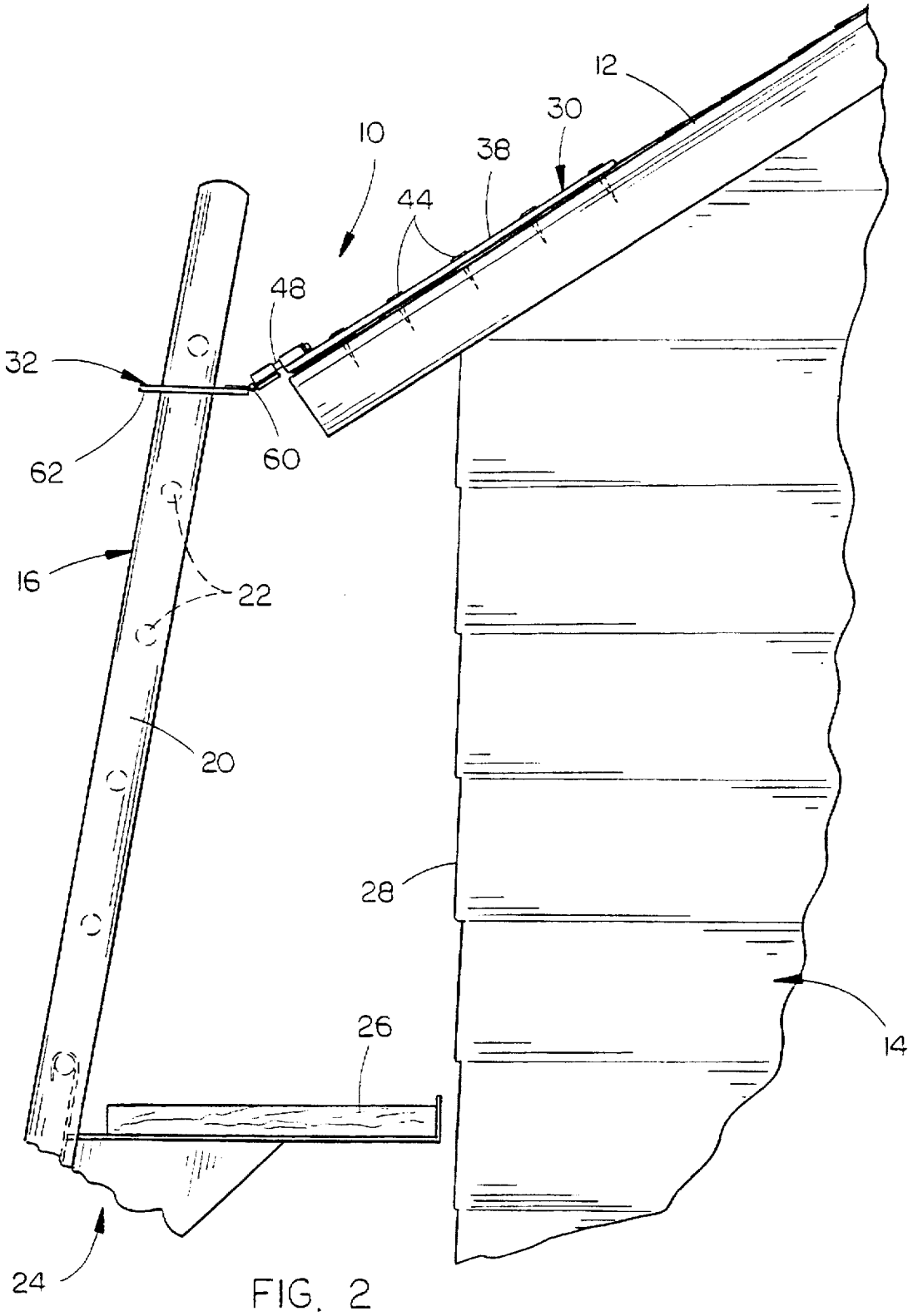
FIG. 2 is a side elevational view of the invention holding a ladder in position.
Figure 3:
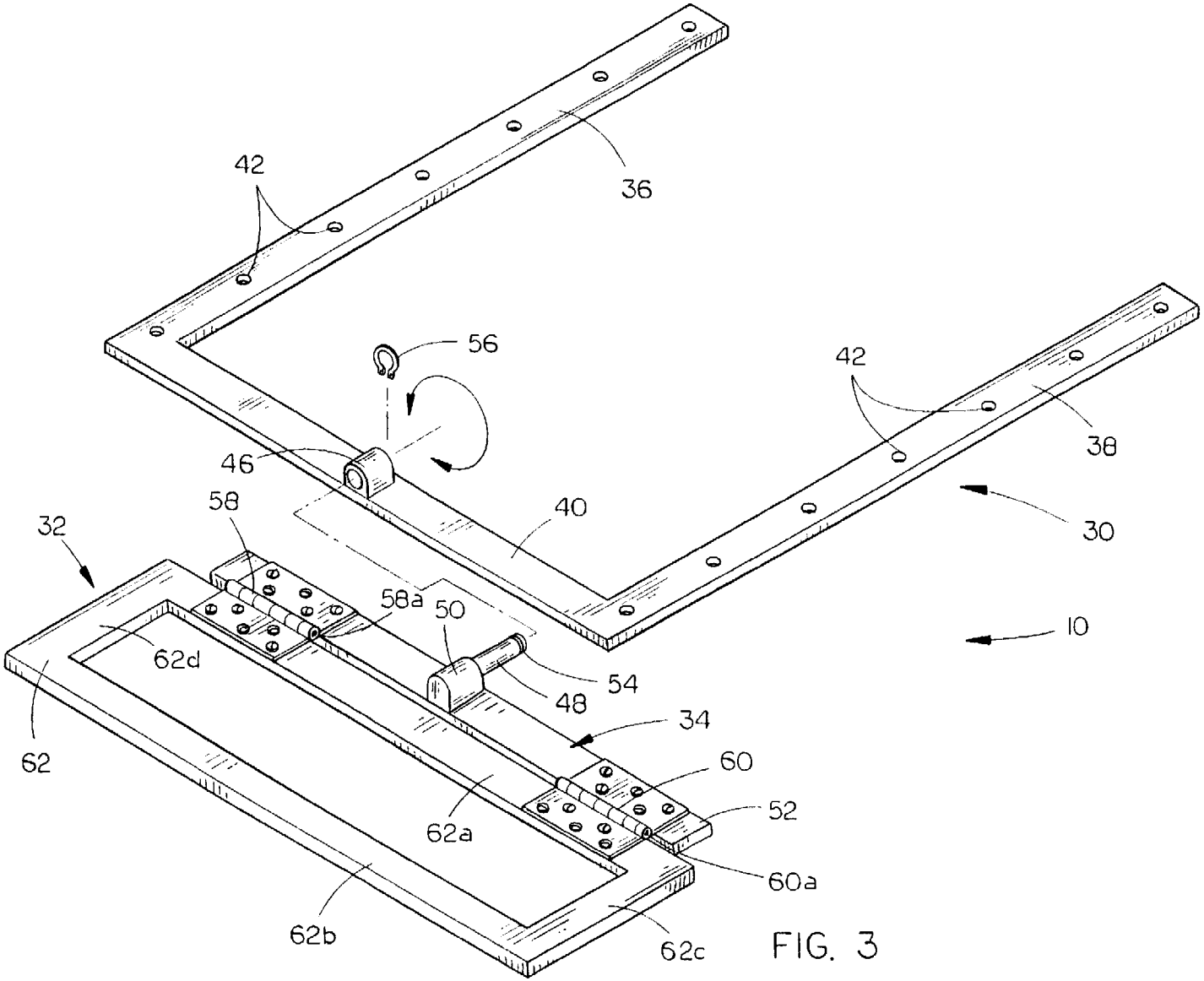
FIG. 3 is an enlarged perspective view of the ladder support of the present invention.

Referring now to FIG. 3, ladder support 10 includes a roof attachment portion 30, a ladder retention portion 32, and an intermediate portion 34 which operably interconnects the roof attachment portion 30 and ladder retention portion 32. Roof attachment portion 30 is a generally U-shaped rigid member having a pair of parallel spaced apart legs 36 and 38 connected at rearward ends by a base 40. Each leg 36 and 38 includes a plurality of apertures 42 formed vertically through the legs and uniformly spaced apart along the length of the legs. Apertures 42 will receive nails, tacks, or similar fasteners 44 as shown in FIGS. 1 and 2 to removably fasten roof attachment portion 30 to roof 12.

Continuing to refer to FIG. 3, a collar 46 is mounted on base 40 generally centrally between legs 36 and 38, and has a longitudinal axis oriented parallel to legs 36 and 38. Collar 46 will receive a pin 48 therethrough, and permit rotatable movement of roof attachment portion 30 about the longitudinal axis of pin 48.

Pin 48 projects forwardly from a mounting base 50 located generally centrally along strap 52, forming intermediate portion 34. Pin 48 has an annular groove 54 around its forward end for receiving a locking clip 56 in a conventional fashion, to permit free rotatable movement of roof attachment portion 30 on pin 48 while retaining collar 46 on pin 48.

Intermediate portion 34 includes strap 52, oriented orthogonal to the longitudinal axis of pin 48 and having a pair of spaced apart hinges 58 and 60 connected to opposing ends thereof. Hinges 58 and 60 are oriented with their pivot pins **58*a* and 60*a* generally coaxial, and orthogonal to the longitudinal axis of pin 48**.

Ladder retention portion 32 is a strap formed in a loop 62 having forward and rearward opposing legs **62*a* and 62*b* and opposing side legs 62*c* and 62*d*. Hinges 58 and 60 pivotally connect forward leg 62*a* to strap 52 to pivot about hinge pins 58*a* and 60*a*, parallel to loop side leg 62*a* and strap 52**.

Referring once again to FIGS. 1 and 2, it can be seen that loop 62 of ladder retention portion 32 has dimensions which will permit the upper end of extension ladder 16 to project through the loop 62 and freely slide up and down therethrough. Typically, ladder 16 will be first set against the building structure and then ladder support 10 will be connected to the upper end of ladder 16 by journaling ladder 16 through loop 62 and dropping ladder support 10 on to roof 12. Hinges 58 and 60 will permit roof attachment portion 30 to lie flush on roof 12, regardless of the slope of the roof relative to the ladder 16. The rotatable connection of roof attachment portion 30 on pin 48 will allow the roof attachment portion 30 to be pivoted to any necessary angle, including orienting the roof attachment portion in a vertical plane. Thus, roof attachment portion 30 may be attached to a vertical wall or the vertical side of a chimney, or other structure to support the upper end of ladder 16.

Preferably, loop 62 has dimensions great enough to permit extension ladder 16 to be extended or retracted vertically through loop 62, thereby adjusting the vertical height of plank 26 relative to the building wall 28.

Figure 4:
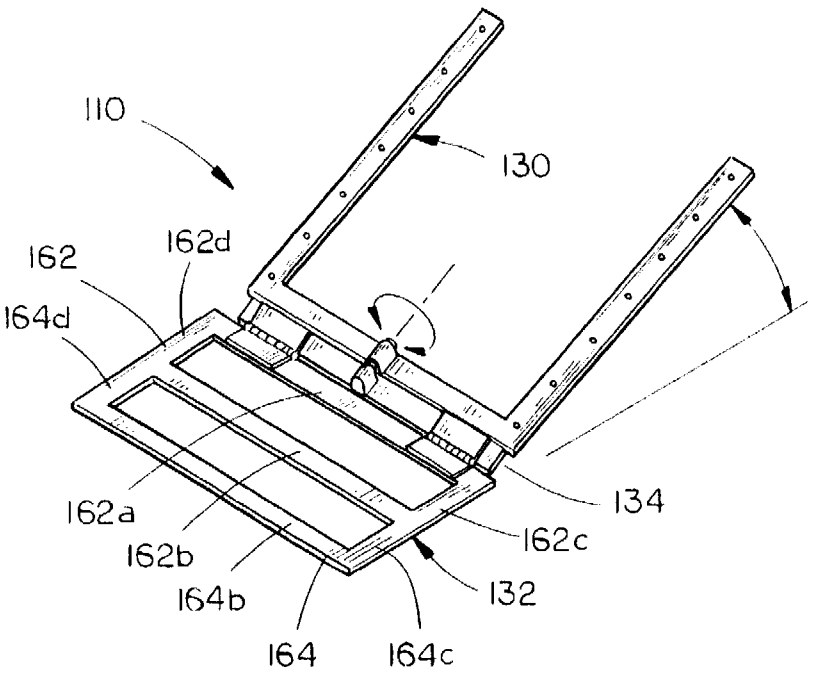
FIG. 4 is an enlarged perspective view of a second embodiment of the invention.

Referring now to FIG. 4, a second embodiment of the ladder support is designated generally at 110. Ladder support 110 is identical to ladder support 10, but with the addition of a second loop 164 rearwardly of the first loop 162. Thus, roof attachment portion 130 is the same as roof attachment portion 30 of the first embodiment, and intermediate portion 134 is the same as intermediate portion 34 of the first embodiment. As noted above, the ladder retention portion 132 differs only in the use of a double loop 162/164 in place of the single loop 62 of the first embodiment.

The second loop 164 includes a rearward leg **164*b* parallel to the rearward leg 162*b* of first loop 162, and opposing side legs 164*c* and 164*d* aligned with the side legs 162*c* and 162*d* of first loop 162**.

Ladder support 110 provides a second loop 164 which will be spaced outwardly from a roof a greater distance than first loop 162, thereby holding a ladder retained within loop 164, spaced away from the building a greater distance than would be possible with the first loop 162. This is especially useful in situations where gutters are being attached to the eaves of a roof.

Figure 5:
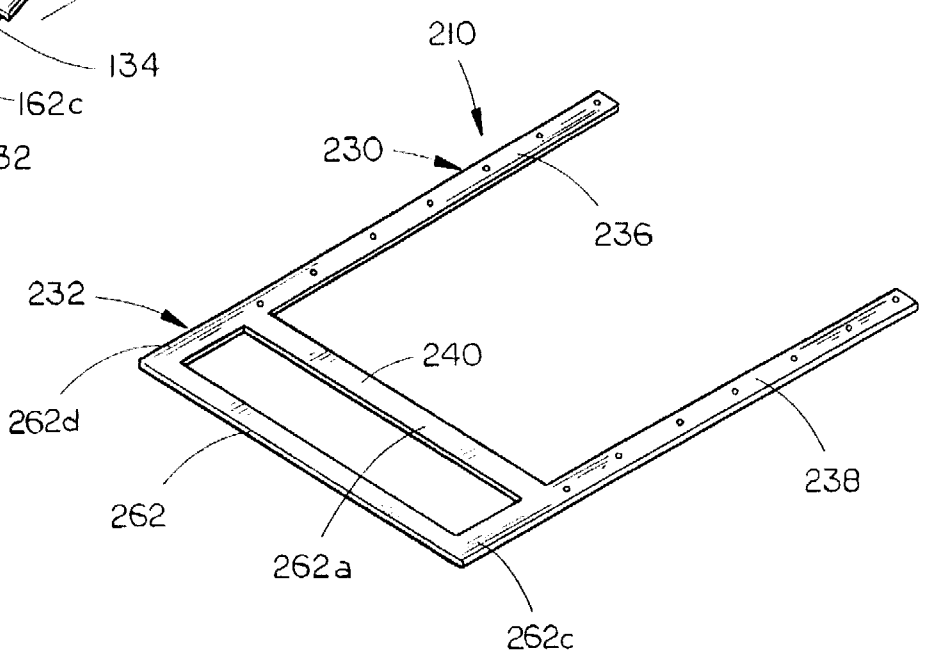
FIG. 5 is a perspective view of a third embodiment of the invention.

Referring now to FIG. 5, a third embodiment of the ladder support is designated generally at 210. Ladder support 210 is the broadest version of the invention, having the roof attachment portion 230 affixed directly and rigidly to the ladder retention portion 232 to form a single integral structure. Thus, legs 236 and 238 are coaxially aligned with the side legs **262*b* and 262*c* respectively. In addition, the base 240 of roof attachment portion 230 forms the forward leg 262*a* of loop 262. While ladder support 210** is not as versatile as the preferred embodiment of the invention, it will function to retain an extension ladder in position adjacent a roof.

Whereas the invention has been shown and described in connection with the preferred embodiment thereof, many modifications, substitutions and additions may be made which are within the intended broad scope of the appended claims.

I claim:

1. A ladder support apparatus, comprising:

a generally U-shaped roof attachment portion, having a pair of spaced apart legs connected at rearward ends to a base;

each leg having at least one aperture formed generally vertically therethrough receive a fastener nail;

a ladder retention portion connected to the base of the roof attachment portion;

said ladder retention portion including a strap formed into a loop having opposing forward and rearward legs and opposing side legs, said roof attachment base connected to the forward leg of the ladder retention portion;

an intermediate portion connected between the roof attachment portion and ladder retention portion;

said intermediate portion including an elongated strap pivotally mounted parallel to the ladder retention portion loop forward leg, for pivotal movement about a pivot axis parallel to both the intermediate portion strap and the loop forward leg strap;

said roof attachment portion base being connected to the intermediate portion strap; and means for rotatably connecting the intermediate portion strap to the roof attachment portion base, for rotatable movement of the base on an axis orthogonal to both the base and the intermediate portion strap.

2. The apparatus of claim 1, wherein said loop has dimensions great enough to slidably receive an upper end of an extension ladder therethrough.

3. The apparatus of claim 2, wherein said means for rotatably connecting the roof attachment portion to the intermediate portion is located generally centrally on both the roof attachment portion base and the intermediate portion strap.

4. The apparatus of claim 3, further comprising a second loop affixed co-planar to the ladder retention portion loop and extending rearwardly from the ladder retention loop rearward leg.

5. The apparatus of claim 4, wherein said ladder retention portion loop is rectangular in shape, with said forward and rearward legs longer than said side legs.

6. The apparatus of claim 5, wherein said second loop is rectangular, with opposing forward and rearward legs and opposing side legs, and wherein the ladder retention portion loop rearward leg forms the second loop forward leg.

7. The apparatus of claim 1, wherein said means for rotatably connecting the roof attachment portion to the intermediate portion is located generally centrally on both the roof attachment portion base and the intermediate portion strap.

* * * * *